US005735082A

United States Patent [19]

Lecuyer et al.

[11] Patent Number: 5,735,082

[45] Date of Patent: Apr. 7, 1998

[54] CHIMNEY ACCESS WITH FLOATING HEAD

[75] Inventors: Maurice Lecuyer, St-Rémi; Réjean Tremblay, Candiac; Pierre Bergeron, Montréal; Antonio Tavares, Candiac; Raymond LeBlanc, Châteauguay; Robert Tallard, Longueuil, all of Canada

[73] Assignee: Lécuyer et fils Ltée, St-Rémi, Canada

[21] Appl. No.: 689,610

[22] Filed: Aug. 12, 1996

[51] Int. Cl.[6] ..... E02D 29/14

[52] U.S. Cl. ..... 52/20; 52/218; 404/26

[58] Field of Search ..... 52/29, 2, 169.7, 52/19, 218; 404/25, 26, 72

[56] References Cited

U.S. PATENT DOCUMENTS

| | | | |
|---|---|---|---|
| 2,900,893 | 8/1959 | Wiedenroth | 52/218 X |
| 5,095,667 | 3/1992 | Ryan et al. | 404/26 X |
| 5,360,131 | 11/1994 | Phillipps et al. | 404/26 X |

FOREIGN PATENT DOCUMENTS

| | | | |
|---|---|---|---|
| 1289799 | 10/1991 | Canada . | |
| 1470870 | 4/1989 | U.S.S.R. | 52/2 |

*Primary Examiner*—Creighton Smith

*Attorney, Agent, or Firm*—Edwin E. Greigg; Ronald E. Greigg

[57] ABSTRACT

Disclosed is a chimney access structure which is particularly well adapted for use in grounds subject to freezing. This structure incorporates chimney provided with an upper end on which is mounted an adaptor provided with a vertical through-hole and with a countersink hole of greater diameter that the through-hole. The countersink hole is preferably frusto-conical and extends coaxially within the through-hole at a given depth from the upper face of the adaptor. This countersink hole defines a sleeve with upper portion of the adaptor which is provided with an inwardly projecting flexible sealing ring. A floating head is slidably mounted into the sleeve. This head has a vertical through-hole coaxial with the one of the adaptor. The floating head also has a lower portion provided with an outer lateral surface whose shape and size are selected to fit into the countersink hole of the adaptor and sealingly slide within the same thanks to the sealing ring. A cover-supporting frame and a chimney access cover are fixed on top of the floating head. Thanks to its structure, this chimney access does not suffer from any of the problems presently encountered with the existing chimney access structures, such as unwanted infiltration or jamming of the floating head due to an accumulation of granulates or to a lateral deflection thereof that may occur when the ground is freezing and thawing.

11 Claims, 4 Drawing Sheets

CHIMNEY ACCESS WITH FLOATING HEAD

BACKGROUND OF THE INVENTION

Field of the Invention

The present invention relates to a chimney access provided with a floating head. It also relates to an adaptor for use to mount said floating head at the upper end of the chimney access.

In the following specification and claims, the term "chimney access" means any kind of chimney giving access to an underground chamber, and any kind of manhole or catch basin like those used to have access to underground chambers in which are located equipments used by public or private utilities for handling wastewater, drinking water, telecommunication and/or electrical distribution networks and the like. Such chimney access usually consists of a stack of prefabricated concrete modules forming a chimney of uniform transversal cross-section, on top of which is mounted a cover supporting frame and a cover whose upper surface extends at the same level as the surface of the ground or roadway.

BRIEF DESCRIPTION OF THE PRIOR ART

During installation of such a chimney access, it is common practice to install sealing joints between the cover-supporting frame and the chimney and between the modules of the same, in order to avoid any infiltration of water, granulates or any other kind of material. Such infiltration is particularly important when the ground water table is high during the thawing period in spring or in the case of high rains.

In spite of all the precautions that may be taken to provide suitable sealing, the modules of the chimney and the cover-supporting frame which are located close to the ground level are subject to raising and lowering during freezing and thawing. Such motion causes damage to the sealing joints, which may even break. Such motion also causes a disconnection of the male and female joints of the modules. As a result, there can be infiltration inside the chimney not only of water, but also of the granulates or other material used as fillers around the chimney.

This phenomenon results in a plurality of problems such as:

- an excess of water supply to the waste water treatment plant;
- a need for frequent cleaning of the chambers and underground equipments;
- damages caused to the structural components to the chimney access which do not move perfectly down to their original position during thawing;
- structural damages to the private or public vehicles which may hit the upper part of the chimney when the same has not moved down to its original position after thawing and thus extends above the level of the roadway;
- physical damages due to vehicles which may hit the upper part of the chimney which has not moved down to its original position and thus extends above the level of the roadway;

etc . . .

In addition to the above phenomenon and the problems generated by the same, it is also known that the paving of the roadway usually raises up more than the chimney during freezing, thereby causing a depression in the roadway. This causes other problems, such as:

- physical damages due to vehicles which may fall within the depression caused by the upper part of the chimney which extends below the level of the roadway;

etc . . .

To tentatively overcome these problems that are mainly caused by alternate freezing and thawing of the ground occurring each year, Canadian patent No. 1,289,799 issued on Oct. 1, 1991 in the name of the Applicant suggests to use a floating head on the top of the chimney. This head comprises a body having a skirt shaped to slide on the upper end of the chimney, on the external surface thereof.

Dilatation of the ground in the freezing zone raises the floating head which moves together with the adjacent ground and paving. The very same motion is obtained, in the reverse way, during thawing. The skirt of the floating head slides along the chimney, which thus remains stationary.

The floating head described in Canadian patent No. 1,289,799 allows for the external top surface of the cover-supporting frame and the cover to be permanently at the same level as the adjacent paving, whether or not the ground is frozen. This floating head also avoids the need of a sealing joint between the cover-supporting frame and the upper module of the chimney, thereby resulting in substantial savings in time, maintenance and components. Moreover, as this floating head is a monolithic element, there is no infiltration of water or other material. Last of all, since the floating head follows the movement of a paving, the later is not subject to shearing.

If all the above advantages are particularly interesting, some problems remain unsolved.

First of all, because of its external positioning on top of the chimney, the skirt of the floating head necessarily has a diameter which is greater than the diameter of the chimney. After their several cycles of freezing and thawing, accumulation and packing of granular material may occur under the lower part of the skirt, thereby jamming the same. Such accumulation, in turn, may require that the chimney be dismantled.

Secondly, due to such positioning, the floating head can move only in the direction of the axis of the chimney. If the floating head is subject to lateral forces, as may occur when the chimney access is adjacent in a ditch nearby a roadway where freezing does not occur equally, the floating head may even jam.

SUMMARY OF THE INVENTION

It has now been discovered that the additional problems found by the Applicant may easily be solved if, instead of using a floating head externally mounted onto the chimney, use is made of a floating head sliding within a sleeve preferably frusto conical in shape, which is provided at the upper portion of an adaptor fixed to the upper end of the chimney, under the freezing line.

Based on such discovery, the present invention provides a new chimney access structure comprising, in combination:

(a) a chimney provided with an upper end of a given shape and size defining an opening;

(b) an adaptor provided with a vertical through-hole and with a lower face of a shape and size corresponding to the shape and size of the upper end of the chimney, this lower face lying onto the upper face, the adaptor being also provided with an upper face and with a countersink hole of a bigger size than the trough-hole, the countersink hole extending coaxially with respect to the through-hole at a given depth from the upper face of the adaptor and defining within the same supporting flange extending above the lower face thereof, the adaptor thus having an upper portion defining a sleeve;

(c) a floating head provided with another vertical through-hole coaxial with the axis of the adaptor, this floating head having a lower portion provided with an outer lateral surface having a shape and size selected to fit into the countersink hole and slide within the sleeve defined by the adaptor, the floating head having also an upper portion ending at an upper surface;

(d) a cover-supporting frame and a cover fixed directly or not onto the upper surface of the floating head; and (e) flexible sealing means extending in the upper portion of the adaptor in between the same and the adjacent lower portion of the floating head.

The chimney access according to the invention is particularly devised for use in a ground that is subject to freezing down to a given depth, hereinafter called "freezing line". In such a case, the chimney is selected so that its upper end is located under the freezing line, and the adaptor is selected so that the supporting flange defined by its countersink hole is substantially at the level of the freezing line and the upper face of the adaptor is, accordingly, above the freezing line. In such a case also, the upper portion of the floating head has its outer lateral surface provided with asperities to favor connection with the surrounding ground during freezing and thawing.

According to a preferred embodiment of the invention, the countersink hole of the adaptor is frusto conical in shape. This allows for a slight omnidirectional deflection of the floating head when this head moves vertically within the sleeve.

Preferably, the sealing means may comprise a protective membrane mounted on the upper face of the adaptor so as to engage the outer external lateral surface of the floating head and thus act as a barrier and retain granulates and other materials that would otherwise impede movement of the floating head. It may also include a seal of the A-LOK® or P-LOK® type mounted within the sleeve.

Thanks to its structure and assembly, the chimney access according to the invention does not suffer from any of the additional problems listed hereinabove, which are encountered in the existing chimney accesses. Since the floating head slides within the adaptor, the problem of accumulation and packing of material resulting in jamming the head does not exist any more.

The sealing problems usually encountered are also solved.

Last of all, when the counterhole is frusto conical, the jamming problem that may be caused by a slight lateral defection of the floating head is also avoided.

The adaptor of the chimney access according to the invention is new per se. Accordingly, this adaptor is also claimed as such hereinafter.

BRIEF DESCRIPTION OF THE DRAWINGS

The invention and its numerous advantages will be better understood upon reading of the following, non-restrictive description of three preferred embodiments thereof, made with reference to the accompanying drawings in which.

In these figures, the same reference numerals have been used to identify the same structural elements.

DESCRIPTION OF THREE PREFERRED EMBODIMENTS

Figure 1:
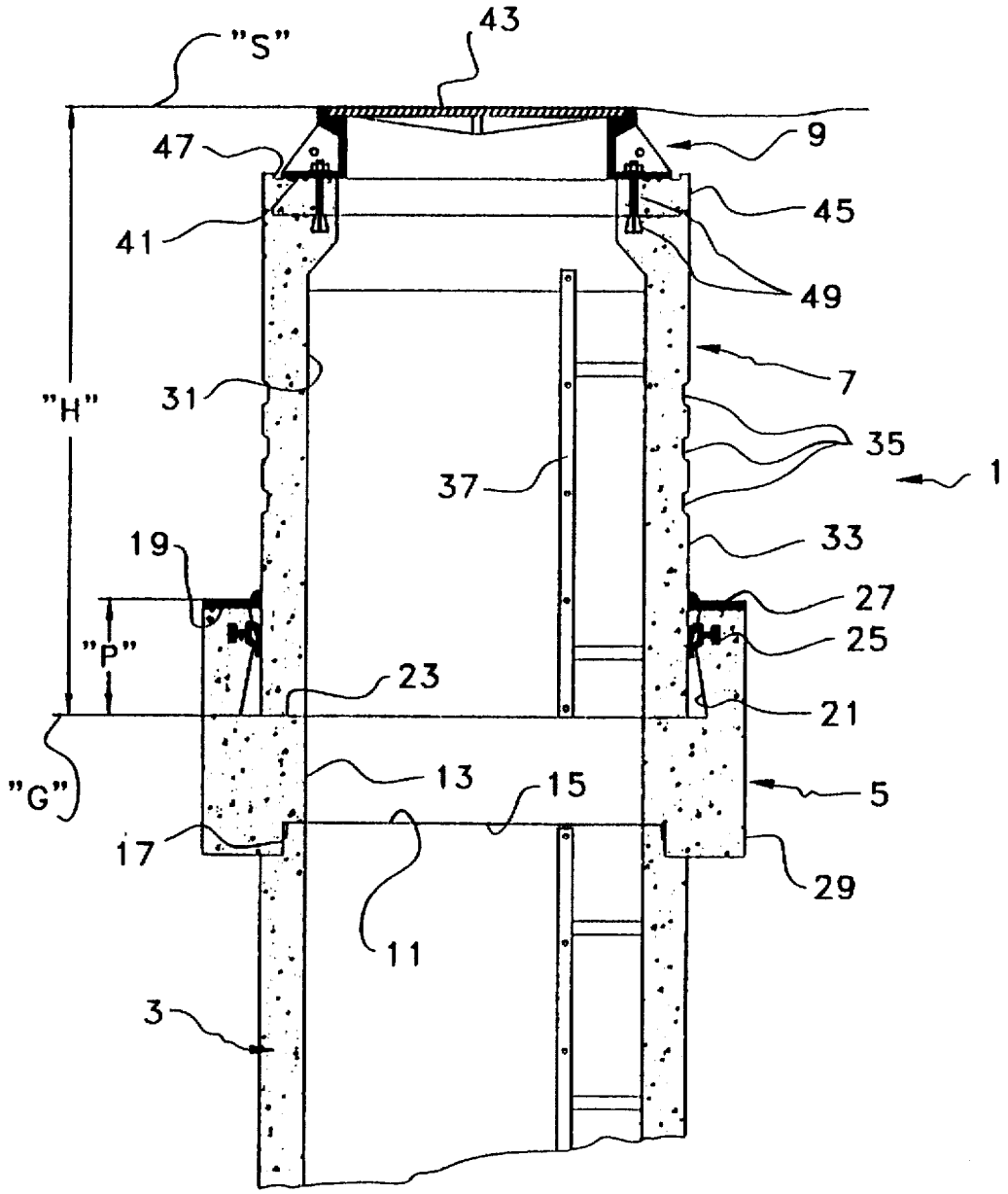
FIG. 1 is a vertical cross-sectional view of a chimney access according to a first preferred embodiment of the invention.

The chimney access 1 according to the invention as shown in FIG. 1 comprises four basic elements, viz.:

a) a chimney 3 b) an adaptor 5 c) a floating head 7; and d) a kit 9 comprising a cover-supporting frame, a cover and optionally one or more levelling rings.

The chimney access 1 is particularly well adapted for use in places where the ground "S" is subject to freezing during a given period of the year and thus freezes over a given depth "H" down to a line "G" hereinafter called "freezing line", the position of which of course depends on the climatic conditions.

Each element listed hereinabove may have a horizontal cross-section of any shape: circular, oval, square, rectangular, etc. In the accompanying drawings and following description, all the elements will be shown and described as having a circular cross-section, since this is the most current shape in the existing chimneys. It must be understood however that the invention is not restricted to this shape exclusively.

As can be seen, the chimney 3 is tubular in shape and preferably made of modules of concrete stacked one above the other to give access to a chamber, a manhole, a sewer or any other underground equipment. The chimney 3 is provided with an upper end 11 of a given shape and size, defining an opening. From a practical standpoint, the height of the chimney is selected so that its upper end is under the freezing line "G".

The adaptor 5 is mounted directly above the chimney 3. It is used to connect the chimney to the floating head 7. The adaptor is preferably made of concrete but could be made of any other material used for underground construction. The adaptor 5 is provided with a vertical through-hole 13 and a lower face 15 of a shape and a size corresponding to the shape and size of the upper end 11 of the chimney. This lower face may comprise a flange or be defined in a tongue and groove configuration 17 to allow a watertight connection with the upper end 11 of the chimney which is shaped in the very same manner. Sealing of the connection can be completed by means of a seal made of rubber, butyl or any other sealing material, not shown. It is worth mentioning that the lower face of the adaptor could also be flat, especially when the adaptor is intended to be mounted onto a chimney made of bricks, concrete, mortar or any other similar material.

The adaptor 5 is also provided with an upper face 19 and a countersink hole 21 of a bigger size than the through-hole 13. As is shown, the countersink hole 21 extends coaxially with respect to the through hole 13 down to a given depth "P" from the upper face 19 of the adaptor. As such, the countersink hole 21 defines a supporting flange 23 within the adaptor, which is located at a given distance above the lower face 11. Thus, the adaptor 5 has an upper portion defining a sleeve.

Figure 5:
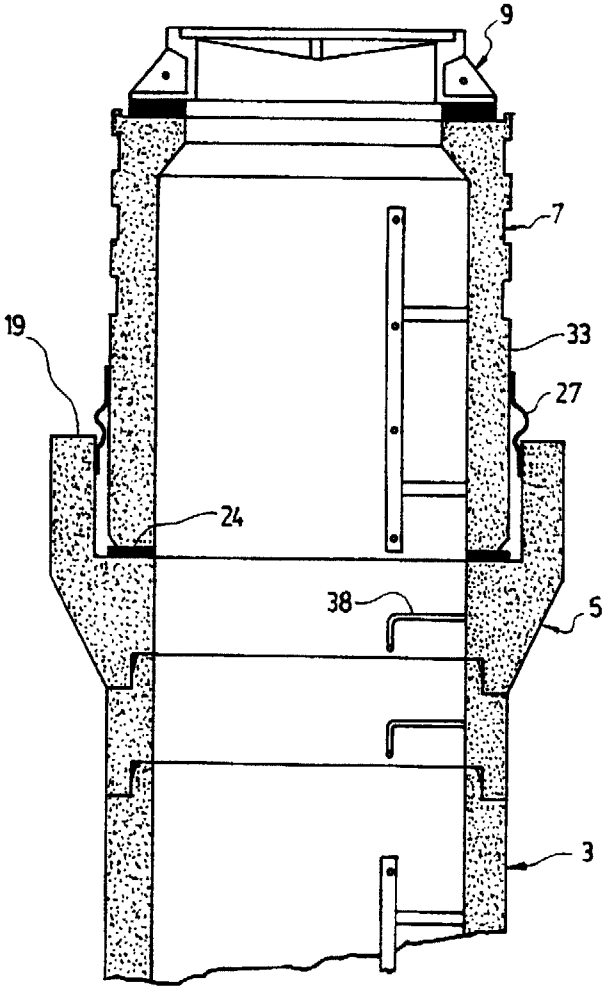
FIG. 5 is a view similar to the previous ones, showing a fifth preferred embodiment of the invention.
Figure 4:
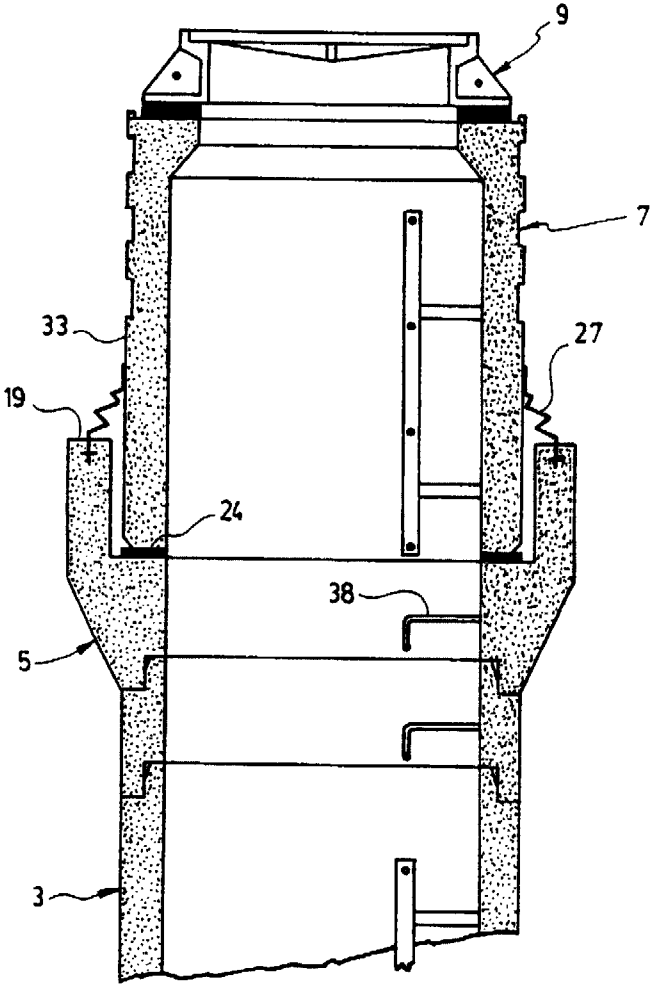
FIG. 4 is a view similar to the previous ones, showing a fourth preferred embodiment of the invention.

If desired, a cushioning ring 24 made of rubber can be positioned on top of the supporting flange 23, as is shown in FIGS. 4 and 5.

The floating head 7 can be monolithic, as shown, or made of several elements attached to each other. The floating head is preferably made of concrete but it could be made of any other material used for underground construction. The height of the floating head depends on the depth "H" of freezing of the ground. Thus, it can vary as a function of geographical area where it is used.

The floating head 7 is provided with a vertical through-hole 31 coaxial with the hole of the adaptor. The floating head has a lower portion provided with an external lateral surface 33 having a shape and a size selected to fit into the countersink hole 21 and slide within the sleeve defined by the adaptor. It also has an upper portion with asperities such as grooves 35, on its external lateral surface, in order to provide suitable connection with the ground during freezing and thawing of the same.

A ladder 37 or individual steps can be incorporated into the through-hole 31 inside the floating head 7 to give access to the chamber extending below. The ladder or steps can be made of steel covered or not with plastic, of aluminium covered or not with plastic, or of any other material used for underground construction. One or more individual steps 38 can also be provided within the vertical through-hole 13 if such is desired see FIGS. 4 and 5).

As shown, the adaptor 5 is selected so that the supporting flange defined by the countersink hole 21 and acting as a support of the bottom portion of the floating head 7, is substantially at the level of the freezing line "G". As a result, the upper face of the adaptor extends above the freezing line.

Because it is mounted below the freezing line "G" and due to its shape and weight, the adaptor 5 remains in position when the floating head 7 moves up and down during freezing and thawing of the ground. Due to its shape, the adaptor has a diameter which exceeds that of the floating head. As a result, the surrounding ground acts as a support for maintaining the adaptor in position.

Figure 2:
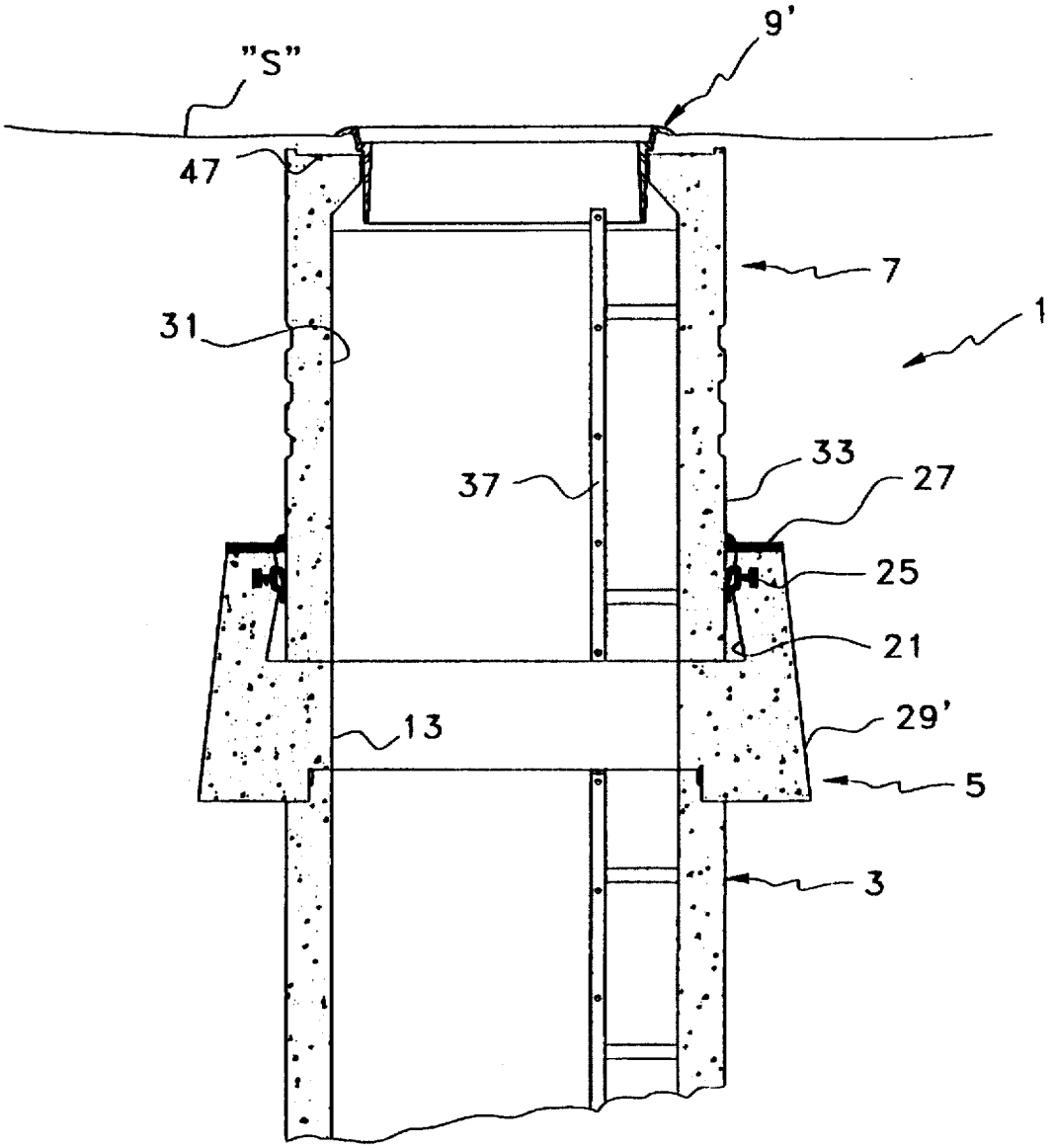
FIG. 2 is a view similar to the one of FIG. 1, showing a second preferred embodiment of the invention.
Figure 3:
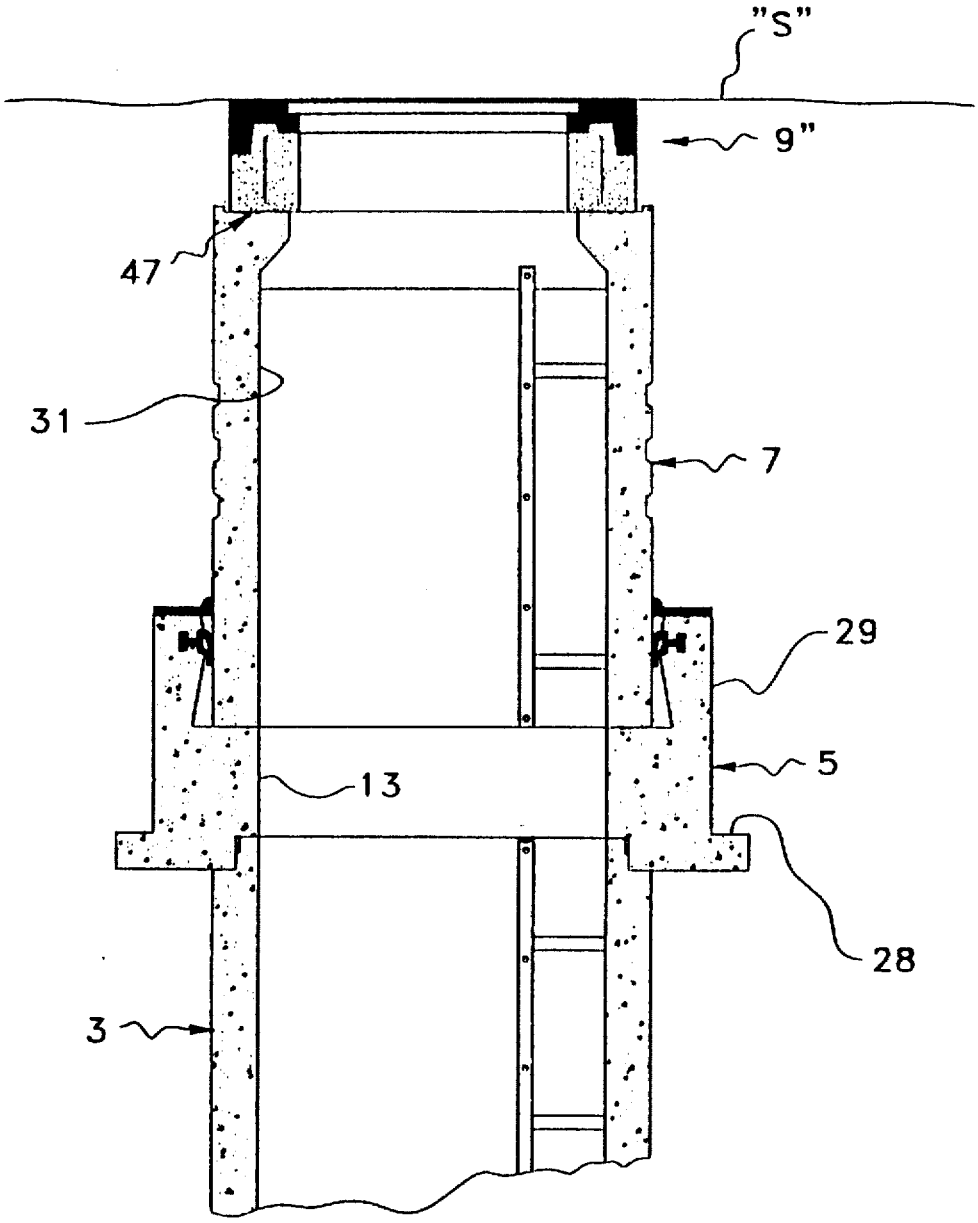
FIG. 3 is a view similar to the one of FIGS. 1 and 2, showing a third preferred embodiment of the invention.

As shown in FIG. 1, the adaptor may have an external lateral surface 29 which is cylindrical. As shown in FIG. 2, it may also have an external lateral surface 29 which is inclined outwardly downwardly to provide a higher resistance when the floating head moves up. Alternatively, the adaptor can be provided with an oversized footing 28 adjacent to its lower face, as shown in FIG. 3. In all cases, the adaptor 5 has an external lateral surface with a shape and a size which substantially exceed the shape and size of the floating head 7 in order to make certain that it remains in position on top of the chimney 3.

It is important that the depth "P" of the sleeve within the adaptor 5 be sufficiently high to permit vertical motion of the floating head 7 during freezing and thawing. This height is variable and depends on the geographical area where the adaptor and floating head are mounted.

In accordance with the invention, the flexible sealing means are provided in the upper portion of the adaptor 5, so as to extend between this upper portion and the adjacent lower portion of the floating head 7. Preferably, such sealing means comprises the protective membrane 27 mounted onto the upper face 19 of the adaptor 5 so as to engage the external lateral surface 33 of the floating head 7 and thus act as a barrier and retain granulates and other material that could otherwise impede the motion of the floating head. This membrane 27 may consist of a rubber ring whose external periphery is fixed to the upper face 19 of the adaptor 5 and the inner periphery is in contact with the external lateral surface 33 of the floating head, as shown in FIGS. 1 to 3. Alternatively, the membrane 27 may consist of a flexible skirt having one end attached to or embedded within the upper face 19 of the adaptor and another end attached to the external lateral surface 33 of the floating head, as shown in FIGS. 4 and 5. In the latter embodiment, the attachment of the skirt to the floating head can easily be completed with clamps made of stainless steel or any other rigid material.

Advantageously, the sealing means may also comprise a seal 25 mounted within the sleeve, which is preferably of the type sold under the trademarks A-LOK® or P-LOK®, as shown in FIGS. 1 to 3.

As shown, the countersink hole 21 of the adaptor 5 is preferably frusto-conical in shape to allow for a slight omnidirectional deflection of the floating head when the same moves up and down within the sleeve. It is worth mentioning that, whatever be the shape of the countersink hole 21, the sealing means provides the required water tightness between the adaptor of the floating head, even in places where the ground water table is substantial, or during melting of the snow. The sealing means also gives flexibility to the floating head when the same moves up or down during freezing or thawing. More particularly, it allows for an omnidirectional deflection of the floating head in the case where the motion of the floating head is not perfectly vertical.

The floating head 7 acts as a base for the cover supporting frame and the cover mentioned hereinabove. In FIG. 1, these structural elements are respectively numbered 41 and 43. As shown, the inner portion of the upper surface of the floating head 7 may comprise a flange 47 sized to fit to the cast-iron frames and covers presently in use. Alternatively, the upper surface of the floating head can be provided with a projection to avoid lateral motion of the cast-iron frames and covers or levelling rings.

The upper surface of the floating head can also be provided with grooves to permit the installation of a sealing ring between the floating head and the frame, or between the floating head and the levelling rings.

If desired, one or more levelling rings 45 can be mounted on the upper size of the floating head 7. These rings can be flat or inclined in order to fit the shape of the roadway. They can be made of metal, concrete, (as shown in FIGS. 1 to 3), rubber (as shown in FIGS. 4 and 5), or any other material compatible with underground construction.

The fixation of the supporting frame and/or levelling ring(s) to the upper surface of the floating head can be made with anchors, bolts and nuts 49, or any other kind of fixation means. The anchors or bolts and nuts 49 can be made of steel, plastic or any other kind of material compatible with underground construction.

As can now be understood, the dilatation that occurs when the ground is freezing raises the floating head 7, as the same moves up together with the ground and the paving extending on it. The very same phenomenon occurs in the reverse way during thawing. The floating head 7 slides down within the sleeve of the adaptor 5, which remains stationary.

Thus, the floating head 7 permits one to reduce the use of shims rings and ensures that the external surface of the supporting frame and cover are permanently at the same level as the adjacent paving, whatever be the period of the year. The floating head 7 also reduces the use of sealing joints between those shims that are otherwise required, thereby causing a substantial reduction in the time and pieces required for maintenance purpose. The floating head 7 is preferably monolithic, because, in such case, there is no infiltration of water or granular material. Since the floating head 7 moves up and down with the paving, the same is not subject to shearing. For the same reason, the supporting frame and cover do not constitute any more of a danger for the vehicles. Moreover, as the chimney 3 is not affected by the alternation of freezing and thawing, the main joints of the modules of the same are no more subject to breaking or crumbling. Furthermore, since there is no more infiltration of granular material through the floating head, there is no lowering of the ground in the freezing zone. Last of all, the ladders or steps are not subject to any change, since they are connected to elements of the chimney access that are independent from each other.

Of course, numerous modifications could be made to the embodiments that have been disclosed hereinabove without departing from the scope of the present invention. Thus, for example, in the illustrated embodiments, the diameters of the chimney 3, through-hole 13 of the adaptor and through-hole 31 of the floating head are identical. However, they could be differently sized.

What is claimed is:

1. A chimney access comprising, in combination:

(a) a chimney provided with an upper end of a given shape and size defining an opening;

(b) an adaptor provided with a first through-hole having a vertical axis and with a lower face of a shape and size corresponding to the shape and size of the upper end of the chimney, said lower face lying onto said upper end of said chimney, said adaptor being also provided with an upper face and with a countersink hole of a size larger than the through-hole, said countersink hole extending coaxially with respect to said through-hole at a given depth from the upper face of said adaptor and defining within said adaptor a supporting flange extending above the lower face thereof, said adaptor thus having an upper portion defining a sleeve;

(c) a floating head provided with a second through-hole coaxial with the axis of said adaptor, said floating head having a lower portion provided with an outer lateral surface having a shape and size selected to fit into said countersink hole and to slide within the sleeve defined by said adaptor, said floating head having an upper portion terminating in an upper surface;

(d) a cover-supporting frame and a cover fixed onto the upper surface of the floating head; and (e) flexible sealing means extending in the upper portion of the adaptor between said upper portion of the adaptor and an adjacent lower portion of the floating head.

2. A chimney access of claim 1, for use in a ground that is subject to freezing down to a given depth, said given depth defining a "freezing line", wherein:

said chimney is disposed so that its upper end is located below the freezing line;

the adaptor is selected so that the supporting flange defined by the countersink hole is substantially at the freezing line and the upper face of said adaptor is, accordingly, above the freezing line; and the upper portion of the floating head has an outer lateral surface provided with asperities adapted to favor a connection with the ground during freezing and thawing.

3. The chimney access according to claim 2, wherein the adaptor has an outer lateral surface of a size and shape substantially larger than the size and shape of the floating head so as to facilitate positioning of the floating head at the upper end of the chimney.

4. The chimney access of claim 3, wherein the opening of the chimney, the hole of the adaptor and the through-hole of the floating head are of the same shape and size.

5. The chimney access of claim 4, wherein the chimney, the adaptor, the floating head and the cover-supporting frame are of cylindrical shape and the opening and respective through-holes are round and of a same diameter.

6. The chimney access of claim 5, wherein the countersink hole of the adaptor is frusto-conical in shape in order to allow a slight omnidirectional deflection of the floating head when said floating head moves vertically within the sleeve.

7. The chimney access of claim 6, wherein a flexible sealing means comprises a protective membrane mounted on the upper face of the adaptor so as to engage an outer external lateral surface of the floating head and thus act as a barrier to retain granulates and other materials that could otherwise impede motion of the floating head.

8. The chimney access of claim 7, wherein the upper end of the chimney and the lower face of the adaptor are provided with corresponding tongues and grooves and with a sealing joint to ensure a sealing connection thereto end to end.

9. The chimney access of claim 7, wherein the floating head is provided with steps in its through-hole.

10. The chimney access of claim 7, wherein the upper surface of the floating head is provided with an internal recess to facilitate installation of the cover-supporting frame.

11. The chimney access of claim 8, wherein the chimney, the adaptor and the floating head are made of concrete.

* * * * *